United States Patent [19]

Grady

[11] 4,399,551

[45] Aug. 16, 1983

[54] X-RAY TUBE HAVING ROTATABLE TRANSVERSELY OSCILLATORY ANODE

[76] Inventor: John K. Grady, 111 Flough Rd., Harvard, Mass. 01451

[21] Appl. No.: 191,936

[22] Filed: Sep. 29, 1980

[51] Int. Cl.[3] ..... H01J 35/10

[52] U.S. Cl. ..... 378/126; 378/132; 378/144

[58] Field of Search ..... 313/60; 378/126, 132, 378/144

[56] References Cited

U.S. PATENT DOCUMENTS

| | | | |
|---|---|---|---|
| 2,926,270 | 2/1960 | Zunick | 313/60 |
| 3,398,307 | 8/1968 | Brown et al. | 313/60 |
| 3,836,805 | 9/1974 | Kok | 313/60 |
| 4,162,420 | 7/1979 | Grady | 313/60 |

FOREIGN PATENT DOCUMENTS

| | | | |
|---|---|---|---|
| 519647 | 2/1931 | Fed. Rep. of Germany | 313/60 |
| 1193616 | 5/1965 | Fed. Rep. of Germany | 313/60 |

*Primary Examiner*—Palmer C. Demeo

*Attorney, Agent, or Firm*—James H. Grover

[57] ABSTRACT

An X-ray tube including a chamber enclosing an anode disc rotatable about an axis, and movable transversely with respect to that axis, the tube also enclosing an electron beam source for projecting electrons along a beam directed towards a planar surface of the anode disc. The beam source is disposed so as to direct its beam at an acute angle of incidence to the planar surface of the anode disc and produce X-rays which are thereupon reflected from the anode disc through a window in the chamber.

7 Claims, 2 Drawing Figures

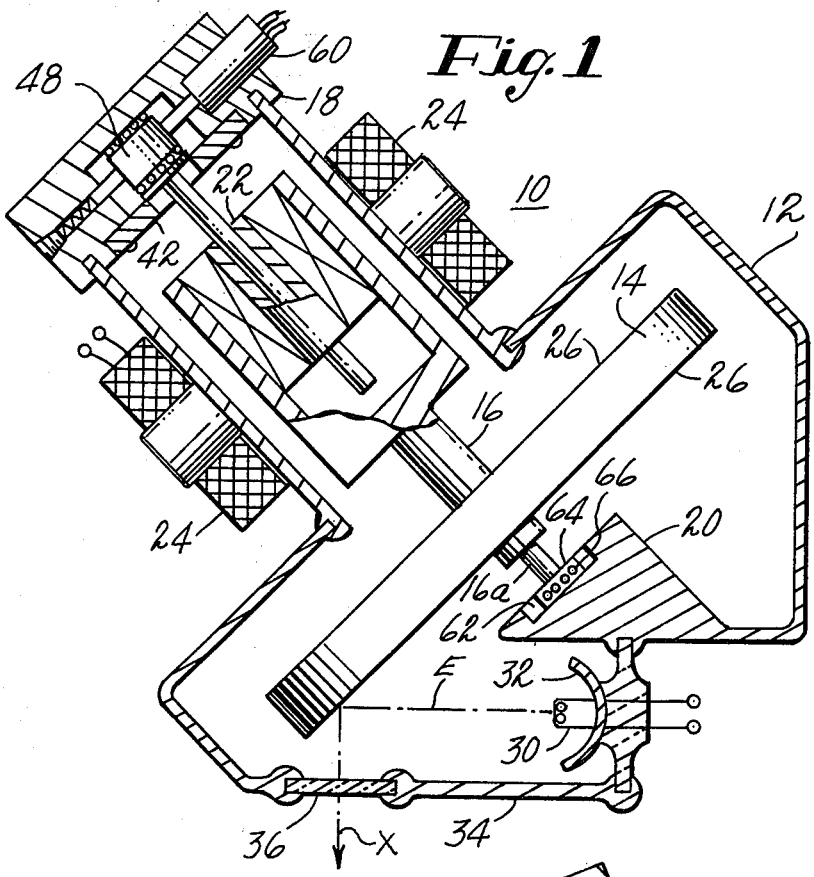
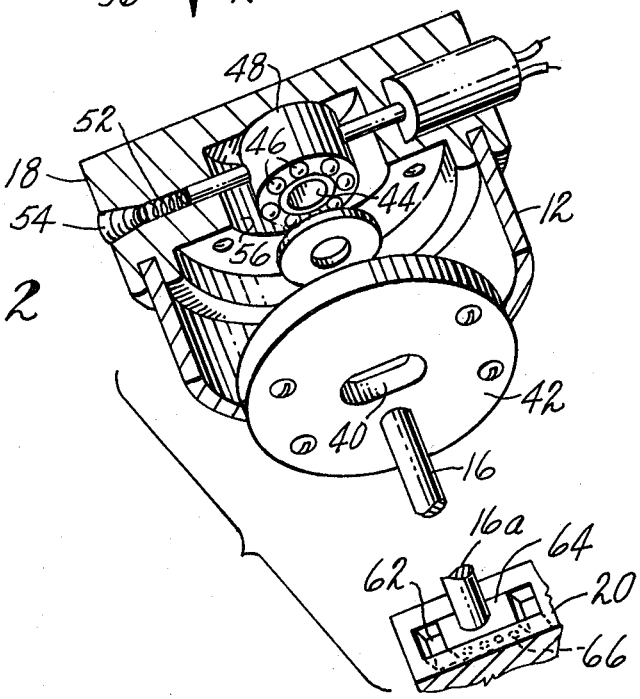
Fig. 2

X-RAY TUBE HAVING ROTATABLE TRANSVERSELY OSCILLATORY ANODE

BACKGROUND OF THE INVENTION (1) Field of the Invention

This invention relates generally to X-ray generators, and more particularly to X-ray generators having rotatable anodes.

(2) Prior Art

A rotatable anode X-ray tube may comprise a disc-like anode rotatably supported in a chamber, the anode being a target, an annular portion of which defines a focal track. The focal track is usually constructed from a high atomic number material such as tungsten or molybdenum which readily emits X-rays when it is bombarded by high energy electrons. A source of electrons is arranged to direct a high energy beam or to the focal track and thereby generate directable X-rays therefrom. The focal track portion of the anode disc is generally disposed at a predetermined target angle with respect to the plane of the disc so that target area or focal spot area is inclined toward an X-ray transparent window on the wall of the chamber. Thus, the X-rays pass through the window in a beam and appear to be emanating as an angled projection from the focal spot area within the tube.

A substantial portion of the electron beam energy that strikes the focal track area is converted to heat which is manifested by a sharp increase in temperature of the target material, frequently as high as 3000° C. In order to avoid pitting or otherwise damaging the focal track surface, the anode disc is rotated at high angular velocities, frequently in the order of 10,000 to 20,000 RPM for example, to move successive segments of the focal track rapidly through the focal spot area that is aligned with the electron beam. As the focal track and target disc rotate, the particular areas which are not being struck with the electrons from the cathode are given an opportunity to cool through radiant dissipation of the heat. Though some heat is dissipated through radiant energy, the heat build up in the disc is frequently greater than the amounts which are dissipated and when the electron beam continues to impinge upon the same track in subsequent rotations of the target disc, the material may become over-heated and possibly permanently damaged. Also, if the tube is allowed to overheat, the bearings on the shaft which support the disc within the chamber can become inoperative.

Rotating anode target structures which have been disclosed in the prior art include a beveled edge disc with the cathode beam impinging upon the beveled surface which in turn generates the X-rays and reflects them through the window. Frequently, the beveled portion of the target anode is a layered bimetallic construction which readily conducts heat from the focal track area into the body of the anode. Such structures are not wholly satisfactory and do not allow maximum loads of cathode ray bombardment over a reasonably long period of time without causing over-heating.

Rotating anode X-ray tubes in which the electrons impinge upon changing surfaces are also known to the art. U.S. Pat. No. 3,836,805 to Kok discloses an anode that is carried on a rotor of a motor, the rotor being driven by a stator and including a pinion gear movable on a slide so that the electron spot changes along the axis of the anode disc as the anode and the rotor are rotated. The anode is shifted axially in response to a heat sensing device which drives the pinion gear and which thereupon changes the positioning of the focal track. With the disclosed construction, the anode can produce substantial amounts of off-focus radiation which especially occurs because the cathode rays are directed at right angles to the surface of the anode.

The U.S. Pat. No. 2,926,270 to Zunick discloses a disc shaped, bevel-type anode which is rotated and wobbled to alter the track upon which the electrons impinge. Upon continual use, this relatively heavy anode can misalign from the desired axial setting of the tube and produce off-focus radiation.

Recently issued U.S. Pat. No. 4,162,420 to Grady discloses an X-ray tube which includes a rotatable anode disc having a peripheral surface which is parallel to the axis of disc rotation, the peripheral surface comprising the focal track of the disc. Electron beams are directed against the peripheral surface and reflect away as X-rays through an appropriate window nearby. The rotative disc is axially reciprocable to permit changes in the locus of points defining the focal track along the peripheral surface.

It is an object of the present invention to provide a rotative disc anode for an X-ray tube, which anode provides for substantial variation of the focal path during disc rotation.

It is a further object of the present invention to provide a rotative disc anode for an X-ray tube which anode provides for excellent heat dissipation during electron beam bombardment thereof to prevent overheating of the anode.

BRIEF SUMMARY OF THE INVENTION

The present invention comprises an X-ray tube that includes a rotatable disc having a planar surface which upon simultaneous rotation and transverse oscillation of its rotating axis provides a fresh target area to an incoming electron beam for a large number of revolutions of the anode, thus generating a sinuous or spirally arranged locus of points as the target area without overlap or cross-over during subsequent anode rotation before heat dissipation thereat.

The disc is disposed on a shaft that is both rotatable and transversely shiftable within a chamber defining the X-ray tube. The shaft extends beyond both sides of the disc and is journalled within the chamber. A rotor or armature is arranged on the shaft and is cooperatively associated with a stator externally disposed with respect to the chamber. The shaft is journalled at each end thereof in supports which permits transverse movement therein during disc rotation. A reciprocating plunger is adapted to a collar supporting the bearings at one end of the rotative shaft, and effectuates upon proper actuation thereof, reciprocal transverse movement in the shaft and in the disc. A grooved bearing supports the other end of the shaft which permits complementary transverse movement of the rotative shaft therewith.

The incoming electron beams directed against the disc may emanate from an electron beam source within the chamber, the outgoing X-ray beam being reflected through an X-ray permeable window in the chamber wall.

BRIEF DESCRIPTION OF THE DRAWINGS

The objects and advantages of the present invention will become more apparent when viewed in conjunction with the following drawings in which:

FIG. 1 is a cross-sectional view of an X-ray tube constructed according to the principles of the present invention; and FIG. 2 is a partial perspective view of the shaft support structure of the present invention.

DESCRIPTION OF THE PREFERRED EMBODIMENT

Referring now to the drawings in detail, and particularly FIG. 1, there is shown an X-ray tube 10 comprising a chamber 12 which encloses a disc-anode 14. The disc-anode 14 is rotatively supported on a shaft 16 which is journalled at a first end in a cap 18, the shaft being journalled at its second end in a bearing member 20. An armature 22 is disposed on the shaft 16 within the chamber 12, and a stator or inductive winding 24 is disposed radially outwardly therefrom, the walls of the chamber 12 being cylindrically arranged therebetween. The disc-anode 14 has an annular periphery and a pair of opposed planar surfaces 26, one of which defines a focal track.

A cathode 30, partially surrounded by a reflective surface 32 is disposed in a housing 34 which comprises a portion of the chamber 12. A window 36 permeable to X-rays is disposed in the wall of the chamber 12 and is positioned to permit X-rays to pass therethrough from a focal area on the focal track of the disc-anode 14. The focal track in the disc-anode 14 is made from a high atomic number material such as tungsten or molybdenum which readily emits X-rays when bombarded by high energy electrons.

The end cap 18 and bearing member 20 are shown more clearly in a sectional-perspective view in FIG. 2. The end cap 18 securely mates with the annularly arranged distal lip of the chamber 12. The shaft 16 extends through an elongated opening 40 in a circular guide plate 42, and into a collar 44. The collar 44 is rotatively journalled by proper bearings 46 in a reciprocable cup 48, which cup 48 is pressed against a push rod 50 by a spring 52 held in place by a screw 54. The cup 48 is slidingly disposed in a mating relationship with a channel 56 arranged in the end cap 18. A regulatable bias means 60 is cooperatively associated with the push rod 50 to effectuate sliding motion of the reciprocable cup 48 in the channel 56. The bias means 60 may be magnetically or pneumatically empowered to cause the slow transverse motion of the cup 48 in the channel 56, the spring 52 being of sufficient capability to cause the cup 48 to slide towards the bias means 60 once the empowerment is discontinued or reduced. Moreover, the bias means could be located at a point the anode disc 14 and guide plate 42 depending upon design considerations. The elongated opening 40 in the circular guide plate 42 has its long axis in parallel with the long axis of the channel 56 in the end cap 18. The guide plate 42 is secured to the inner surface of the end cap 18 to maintain the integrity of the reciprocable cup 48 in the end cap 18 and to insure proper transverse motion of the shaft 16. The bearing member 20 at the other end of the shaft 16 has a linear groove 62 into which fits a slide 64 that houses ball bearings 66. the slide 64 is in parallel alignment with the long axis of the elongated opening 40 in the circular guide plate 40. The distal end **16*a* of shaft 16 is journalled in slide 64 which permits transverse movement of the anode 14**.

During operation of the X-ray tube 10, a beam of high energy electrons, designated E in FIG. 1, is discharged from the cathode 30, which has been energized from a proper source, not shown. The high energy electrons E strike the planar surface 26 of the disc-anode 14, which disc-anode 14 is rotating at speeds of about 10,000 to 20,000 revolutions per minute, being caused to rotate by the cooperation of the armature 22 on the shaft 16, and the stator 24 disposed about the chamber 12. As the beam of high energy electrons E strike the disc-anode 14 an extremely hot focal spot develops which causes the high atomic member metal of the focal track to emit a beam of X-rays designated X in FIG. 1, at an angle corresponding to the angle of incidence of the high energy electrons E.

The rotation of the disc-anode 14 permits the focal track to present a fresh surface as a target area for the flow of high energy electrons. The bias means 60, causes a force against one side of the reciprocable cup 48 which in turn slides very slightly in the channel 56 in the end cap 18. The collar 44, receiving a portion of the shaft 16 therein, induces transverse motion therewith, the distal end **16*a* of the shaft 16 following the cap 48 by movement of slide 64 in groove 62. The transverse motion of both the shaft 16 and the disc-anode 14, as well as the simultaneous rotation thereof, presents a focal track of spiral configuration to the incoming beam of high energy electrons E. The heat generated at the focal area at any given moment has time to dissipate during subsequent high energy electron bombardment of other points along the spiral focal track, permitting extended use of the X-ray tube 10 and minimal problems associated therewith that would be otherwise caused by high temperatures within the X-ray tube 10**.

Thus there has been shown an X-ray tube having a rotatable disc-anode which is also movable transversely with respect to its axis of rotation to provide a spirally arranged focal track target area permitting the high heat generated therein to dissipate prior to successive high energy electron bombardment of the same area.

Though the invention has been described with a certain degree of particularity, it is intended that the appended claims be interpreted as exemplary only.

I claim:

1. An X-ray tube comprising:

a chamber enclosing an electron beam source including a cathode for projecting electrons along a beam axis and a window in said envelope through which X-rays may emerge;

an anode-disc rotatable about a shaft, said disc having a planar surface normal to said axis of rotation, said beam source being disposed so as to direct said electron beam at an angle of incidence to said normal surface to produce an X-ray which is transmitted through said window; and means to impart transverse movement to said disc during rotation thereof including support means engaging respective ends of the shaft, guide means slidingly receiving at least one support means and holding the shaft at a fixed angle to the electron beam axis, and means imparting translatory movement to the shaft, thereby to minimize the quantity of electron beams striking any given path on said disc in any particular time interval.

2. An X-ray tube as recited in claim 1, wherein said shaft has a first end thereof cooperatively disposed within an end cap, said enc cap having bias means linking the end cap and shaft for imparting said transverse motion to said shaft and said anode-disc, said shaft having a second end cooperatively disposed within a disc bearing in rotatable transversely movable relationship therewith.

3. An X-ray tube as recited in claim 2, wherein said end cap receives a bearing therein, said bearing being disposed in an elongated channel to permit transverse movement of said bearing therein.

4. An X-ray tube as recited in claim 3, wherein said bias means is in communication with said bearing, activation of said bias means causing transverse movement of said bearing and said shaft in said bearing in a controlled manner.

5. An X-ray tube as recited in claim 3, wherein said end cap has pressure applying means in communication with said bearing, and is in opposition to said bias means, to effectuate return motion of said bearing in said elongated channel upon de-energization of said bias means.

6. An X-ray tube as recited in claim 3, wherein said end cap has a guide plate disposed about said shaft and against said end cap, said guide plate having an elongated slot therein, said elongated slot having a long axis which is in alignment with the long axis of said elongated channel.

7. An X-ray tube as recited in claim 5, wherein said disc bearing receiving said second end of said shaft has a groove therein, said groove being in alignment with said long axis of said elongated slot in said guide plate and said long axis of said elongated channel in said end cap.

* * * * *